US011535431B2

(12) United States Patent
Wong et al.

(10) Patent No.: US 11,535,431 B2
(45) Date of Patent: Dec. 27, 2022

(54) LID ASSEMBLY OPERABLE WITH ONE PRESS ACTION MECHANISM AND CONTAINER COMPRISING THE SAME

(71) Applicant: KING'S FLAIR DEVELOPMENT LTD., Hong Kong (HK)

(72) Inventors: Siu Wah Wong, Hong Kong (HK); Chi Yeung Chan, Hong Kong (HK); Fat Sun Kwok, Hong Kong (HK); Shun Sang Poon, Hong Kong (HK)

(73) Assignee: KING'S FLAIR DEVELOPMENT LTD., Hong Kong (HK)

( * ) Notice: Subject to any disclaimer, the term of this patent is extended or adjusted under 35 U.S.C. 154(b) by 68 days.

(21) Appl. No.: 17/319,476

(22) Filed: May 13, 2021

(65) Prior Publication Data

US 2021/0354889 A1 Nov. 18, 2021

Related U.S. Application Data

(60) Provisional application No. 63/024,237, filed on May 13, 2020.

(51) Int. Cl.
*B65D 47/26* (2006.01)
*B65D 47/14* (2006.01)
*B65D 47/28* (2006.01)

(52) U.S. Cl.
CPC ..... *B65D 47/265* (2013.01); *B65D 47/14* (2013.01); *B65D 47/283* (2013.01); (Continued)

(58) Field of Classification Search
CPC .... B65D 47/265; B65D 47/14; B65D 47/283; B65D 2251/0025; B65D 2251/0078; B65D 2251/0087; B65D 2547/06; B65D 41/04; B65D 47/06; B65D 53/00; B65D 47/249; B65D 47/242; B65D 47/248; B65D 53/02; B65D 47/266; B65D 2543/00046; B65D 2543/00231; B65D 2543/0025; B65D 2543/00972; B65D 2543/00981; B65D 43/18; B65D 47/245; B65D 47/247; A47G 19/2272; A47G 23/16; A47G 2400/027; F16K 31/523; F16K 31/52491
USPC ..... 220/714, 715, 254.1, 254.4, 254.7–0.9; 222/518, 548, 470, 631, 715, 524; 137/630.1
See application file for complete search history.

(56) References Cited

U.S. PATENT DOCUMENTS 7,073,678 B1 * 7/2006 Dibdin ..... A47G 19/2272 222/548
2004/0040962 A1 * 3/2004 Bielecki ..... A47J 41/0022 220/254.1
2013/0062358 A1 * 3/2013 El-Saden ..... A47G 19/2272 220/254.2

FOREIGN PATENT DOCUMENTS

WO WO-2016070234 A1 * 5/2016 ..... A47G 19/22

* cited by examiner

*Primary Examiner* — Valentin Neacsu
*Assistant Examiner* — John Martin Hoppmann
(74) *Attorney, Agent, or Firm* — WPAT, PC

(57) ABSTRACT

The present invention provides a lid assembly for use in a beverage container, having a cap, a seal assembly configured to sealably close at least one drink orifice, and an actuator assembly. The actuator assembly is in operative connection with the cap and the seal assembly, and configured to synchronously actuate the cap to rotate and actuate the seal assembly to displace longitudinally, so as to open the drink orifice for dispensing and close the drink orifice via a single press action. The invention also relates to a beverage container comprising such a lid assembly.

19 Claims, 13 Drawing Sheets

(52) U.S. Cl.
CPC ..... *B65D 2251/0025* (2013.01); *B65D 2251/0078* (2013.01); *B65D 2251/0087* (2013.01); *B65D 2547/06* (2013.01)

LID ASSEMBLY OPERABLE WITH ONE PRESS ACTION MECHANISM AND CONTAINER COMPRISING THE SAME

RELATED APPLICATION

This non-provisional application claims priority from provisional application No. 63/024,237 filed on May 13, 2020, the disclosures of which are incorporated herein by reference in their entirety.

TECHNICAL FIELD OF THE INVENTION

This invention relates generally to the field of lids for beverage containers, and more particularly, to a lid assembly for a beverage container having an actuator assembly configured for synchronously actuating a seal assembly and a cap to open a drink orifice for dispensing or close the drink orifice via a single press action. The invention also relates to a beverage container comprising such a lid assembly.

BACKGROUND OF THE INVENTION

Lids or covers for covering an opening of a beverage container comprising a mechanism to open or close a drink orifice in communication with the inside and the outside of the container are currently available. Conventionally, lids or covers of this type comprise a seal assembly for closing the drinking orifice and a shield for covering up the drink orifice from the external environment. The seal assembly may be caused to move away from the drink orifice to open the drink orifice and at the same time the shield may be removed for allowing to dispense the beverage from the receptacle of the beverage container. The lids or covers would comprise an actuator mechanism in operative coupling with the seal assembly to control the opening and closing of the drinking orifice. The lids or covers would further comprise locking means mounted on the lid for locking the actuator mechanism in order to prevent or restrict actuation of the actuator mechanism. Thus the actuator mechanism is maintained in its latched position and is not permitted to actuate the seal assembly to inadvertently open the drinking orifice. A user has to, on one hand, unlock the actuator mechanism, and then operates the actuator mechanism to move the seal assembly to open the drink orifice for dispensing the beverage; and on the other hand, remove the shield useful to cover up the drink orifice.

This type of lids or covers has the disadvantage of having cumbersome structure and being inconvenient to operate. Put another way, operating the lids or covers for the dispensing purpose requires at least two steps by both hands of the user, if he/she desires to drink the beverage contained in the receptacle of the beverage container.

Therefore, there is a need for a lid assembly that is easy to handle with one hand and provides the convenience of opening the drink orifice.

SUMMARY OF THE INVENTION

The present invention has been developed to fulfill the needs noted above. Therefore, the present invention has a principal object of providing a lid assembly having a drink orifice which can be opened and closed in an easy and convenient way with less efforts.

A further object of the invention is to provide a lid assembly that is easier to handle with one hand. More particularly, not only the open operation, but also the closing operation of the drink orifice is achieved by an actuator mechanism provided in the lid assembly, which requires only one single press for opening and closing the drinking orifice.

A first aspect of the present invention is to provide a lid assembly for a beverage container, comprising:

- a lid comprising a lid body having a receiving chamber, a lid cover having at least one drink orifice extending therethrough, and a side wall extending downwardly and circumferentially from the lid cover to define an internal space,
- a seal assembly mounted in the internal space of the lid, the seal assembly having a seal carrier and at least one drink seal carried on the seal carrier for closing the drink orifice, wherein the seal carrier is displaceable between an upper position where the drink seal is sealably engageable with the drink orifice, and a lower position where the drink seal is disengaged from the drink orifice,
- a cap rotatably placed over the lid cover and rotatable between an inactive position where the drink orifice is fully covered by the cap and an active position where at least a part of the drink orifice is uncovered by the cap, and
- an actuator assembly in operative connection with the cap and the seal assembly, the actuator assembly configured to synchronously actuate the cap to rotate between the inactive position and the active position, and actuate the seal carrier to be displaceable between the upper position and the lower position, and
- wherein the cap is actuated to rotate to the inactive position when the seal carrier is actuated to the upper position to close the drink orifice, and the cap is actuated rotate to the active position when the seal carrier is actuated to the lower position to open the drink orifice for dispensing the beverage stored in the container.

Preferably, the actuator assembly may be configured to move to be alternately latched in a plurality of latched positions, so that the movement of the actuator to one of the plurality of latched position drives synchronously the cap to the inactive position and the seal carrier to the upper position, and the movement of the actuator to the other of the plurality of latched position drives synchronously the cap to the active position and the seal carrier to the lower position, thereby allowing to close and open the drink orifice.

In an embodiment of the present invention, the actuator assembly may be configured as a ballpoint pen ratchet mechanism arranged in the lid, the ballpoint pen ratchet mechanism comprising:

- a push plunger connected to a compression spring which is forced to move the push plunger upward, at least a part of the push plunger being movably received in the receiving chamber of the lid body and configured to act on the seal carrier so that the seal assembly is displaceable between the upper and lower positions, and
- a ratchet coupled to the cap,
- wherein the push plunger and the ratchet comprise cooperating cam faces whereby the ratchet tends to rotate when the cam faces of the push plunger are forced against the cam faces of the ratchet, and the rotation of the ratchet causes to rotate the cap between the inactive position and the active position.

In one specific embodiment of the invention, the push plunger has an end sleeve and a free end, and the cam faces of the push plunger are formed on an inner wall surface of the end sleeve to cooperate with the cam faces formed on the ratchet.

In one embodiment of the invention, the end sleeve may have a plurality of protrusions formed and arranged evenly in a spaced apart fashion on an outer wall surface thereof; and the cap may comprise a panel with a through hole through which a top of the end sleeve is exposed, and a hollow barrel projecting downwardly from the through hole circumferentially and encasing the end sleeve, the barrel having a plurality of recessed portions formed and arranged evenly in a spaced apart fashion on an inner wall surface of the barrel. The cap is actuated by the ballpoint pen ratchet mechanism such that the recessed portions of the barrel alternately engage with or disengage from the respective protrusions of the end sleeve, thereby allowing the cap to rotate between the inactive and active positions.

In certain embodiments of the invention, the lid cover may have an annular raised rim that encircles the lid cover, and the panel of the cap may have a guiding groove at each end of the panel. The guiding grooves are rotatably fitting onto the raised rim of the lid cover, so as to guide the rotation of the panel with respect to the lid cover. The top of the end sleeve may be configured as a push button that protrudes beyond the through hole of the panel of the cap, which provides the means for pressing the ballpoint pen ratchet mechanism by the user.

In another embodiment of the invention, a hub extends upwardly from a bottom surface of the receiving chamber of the lid body. The push plunger slidably runs through the hub, and the ratchet is configured to be rotatable about the hub. The hub preferably comprises one or more axial slots formed on an inner wall thereof; and the push plunger comprises one or more axial ribs engageable with the respective axial slots, thereby preventing the push plunger from rotation with respect to the lid body.

In a yet embodiment of the invention, the lid assembly may further comprise a valve assembly having a valve body with a first end in contact with the free end of the push plunger and a second end movable to be operably in abutment with the seal carrier. The seal carrier may comprise a bottomed lower member operably in abutment with the second end of the valve body, so that the valve assembly, when pressed by the push plunger, moves to longitudinally displace the seal carrier with the drink seal. The bottom of the lower member may have two opposite openings to allow for two lateral elements of the valve body to movably pass therethrough. The compression spring is arranged for connection to the valve body and held on the bottomed lower member of the seal carrier.

In one specific embodiment of the invention, a spring member may be provided beneath the seal carrier to bias the seal carrier upward. A holder is provided to hold the spring member and secured to the lid body. Two spaced-apart press-fit legs extend from an underside of the receiving chamber and are adapted for passing through the holder in a manner that the press-fit legs press against an inner wall of opposite tabs formed in the holder to create a secure connection therebetween. In this way, the holder of the spring member is securely connected to the lid body.

According to the invention, the cap may be actuated to rotate by an angle in the range of 0 to 90 degrees, preferably 90 degrees, responsive to every single press onto the actuator assembly.

A second aspect of the invention provides a beverage container comprising a container body including an open-top wall structure defining a receptacle for receiving beverage; and a lid assembly according to the invention detachably secured on top of the container body.

BRIEF DESCRIPTION OF THE DRAWING

To have a better understanding of the invention reference is made to the following detailed description of the invention and embodiments thereof in conjunction with the accompanying drawings. In the various figures of the drawings, like reference numbers are used to designate like parts.

DETAILED DESCRIPTION OF THE INVENTION

Figure 1:
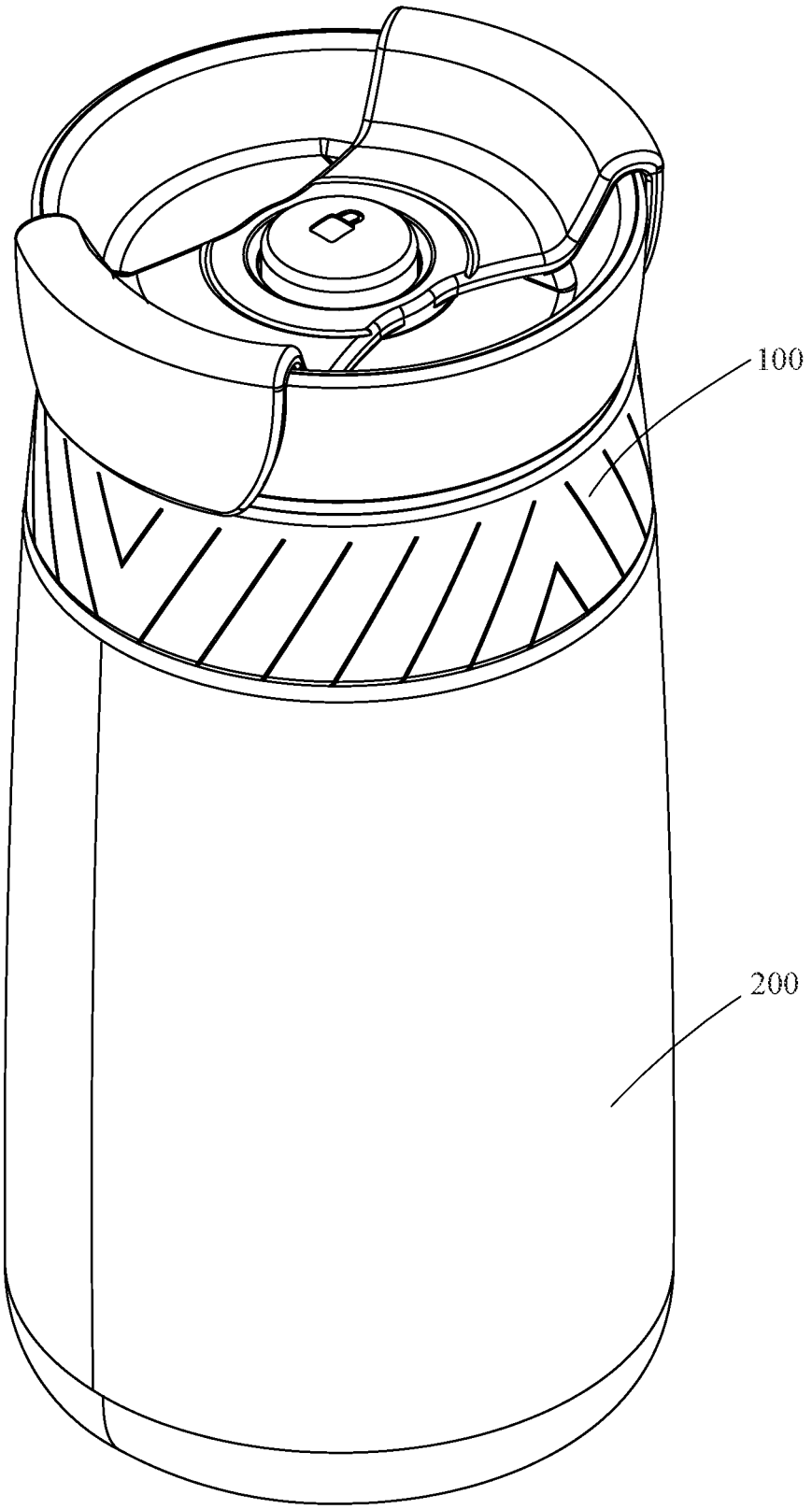
FIG. 1 is a perspective view of an exemplary travel beverage mug in fully closed state, having a lid assembly constructed according to a preferred embodiment of the present invention.

While the present invention is illustrated and described in preferred embodiments, the lid assembly of the present invention may be produced in many different configurations, sizes, forms and materials for dispensing beverage in a beverage container.

Referring now to the drawings, there is illustrated a lid assembly 100 constructed according to a preferred embodiment of the invention and adapted for a travel beverage mug 200. The beverage mug 200 can be of any type shape used to hold cold or hot water, soft drinks or other beverages for consumption. The lid assembly 100 is engaged with the beverage mug through thread mating or in snap-fit manner. As illustrated, the lid assembly 100 comprises a lid comprising a lid body 1, a rotatable cap 2, a seal assembly 3 and an actuator assembly 4.

Figure 3A:
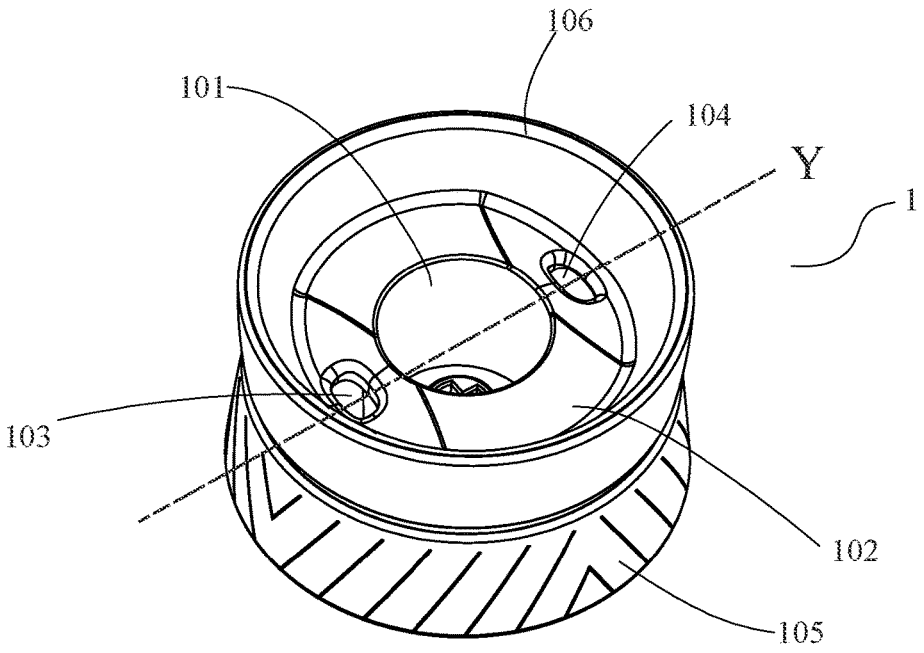
FIGS. 3A and 3B are perspective top and bottom views of the lid shown in FIG. 1.
Figure 3B:
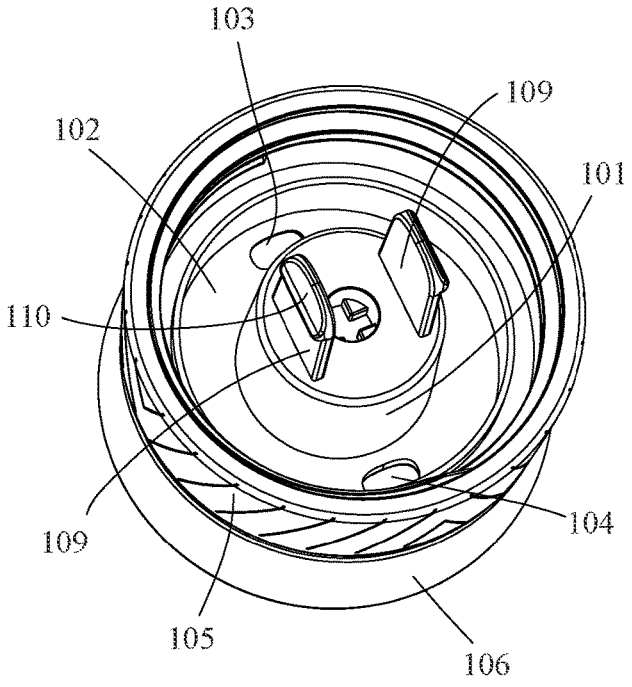
Figure 3C:
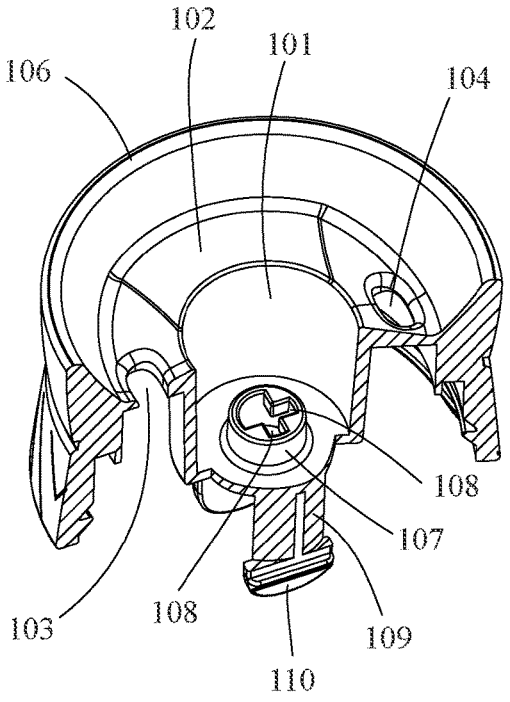
FIG. 3C is a perspective view of the lid in cross-section showing the internal structure of the lid.

Referring to FIGS. 3A to 3C, the lid body 1 is sized and configured to close an opening of the beverage mug 200, and can be detachably secured on the top of the beverage mug 200. The lid body 1 comprises a receiving chamber 101, a lid cover 102 having first and second drink orifices 103, 104 extending therethrough, and a side wall 105 extending downwardly and circumferentially from the lid cover 102 to define an internal space. The first and second orifices 103, 104 are defined in the vicinity of the perimeter of the lid cover 102, and arranged symmetrically relative to a longitudinal axis of the lid body 1 along a diametric axis Y. The first and second orifices 103, 104 may have a same size as or a different size from each other. The lid cover 102 further has an annular raised rim 106 that encircles the lid cover, and the raised rim 106 and the lid cover 102 together define a depression for rotatably mounting the cap 2, which will be discussed herein below. The side wall 105 is adapted to be coupled to the beverage mug 200, for example through threading engagement in the illustrated embodiment.

The receiving chamber 101 is preferably cylindrical and has a hollow hub 107 extending upwardly from a bottom surface of the receiving chamber 101 at a center thereof. The hub 107 comprises two axial slots 108 formed on an inner wall of the hub, as shown in FIG. 3C. Two spaced-apart press-fit legs 109 extending downwardly from an underside of the receiving chamber 101. Each of the two press-fit legs 109 includes a stop portion 110 at its free end.

Figure 4A:
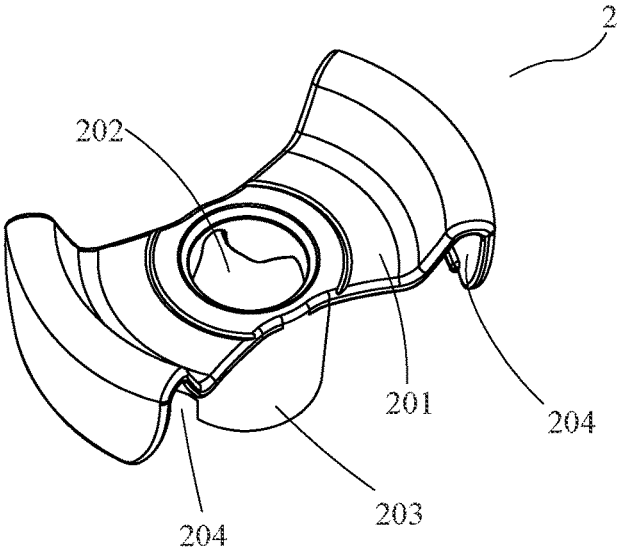
FIGS. 4A and 4B are perspective top and bottom views of the cap shown in FIG. 1.
Figure 4B:
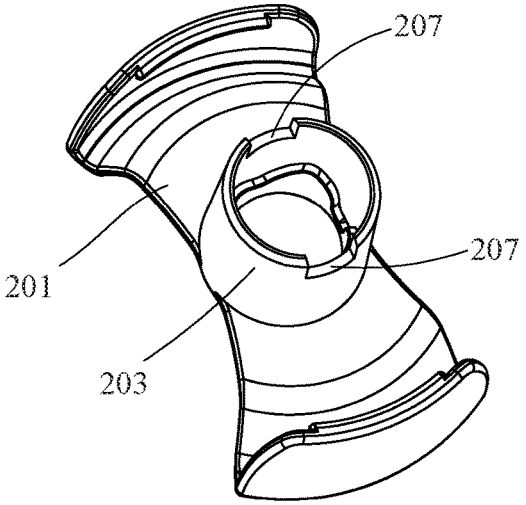
Figure 4C:
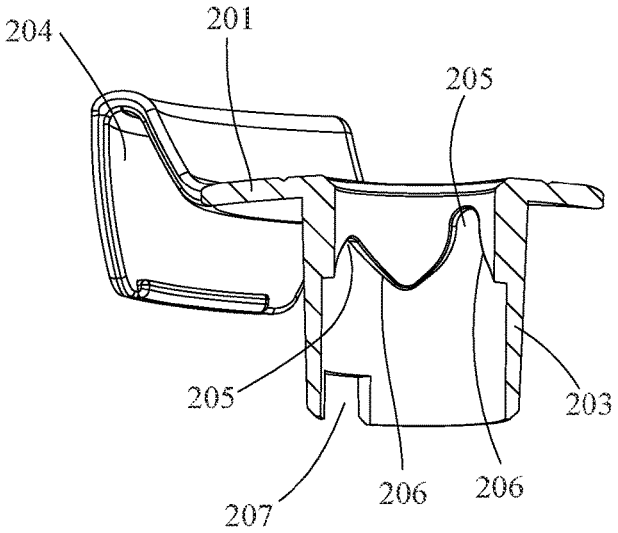
FIG. 4C is a perspective view of the cap in cross-section showing the internal structure of the cap.

On top of the lid cover 102 there is a cap 2 which is rotatably placed on the lid cover 102. As illustrated in FIGS. 4A to 4C, the rotatable cap 2 comprises a panel 201 with a through hole 202 defined at a center of the panel 201, a hollow barrel 203 projecting downwardly from the through hole 202 circumferentially. A guiding groove 204 is provided at each end of the panel 201, and two opposite notches 207 at a bottom circumference of the barrel 203. Four recessed portions 205 are formed and placed evenly in a spaced apart fashion on an inner wall surface of the barrel 203. Each of the four recessed portions 205 has a bottom cam face 206. The four recessed portions 205 are spaced apart with an equal angular interval of 90 degrees and have alternate depths to define alternate latched positions of the actuator assembly 4 at different axial displacements in the barrel 203. In particular, two deep recessed portions and two shallow recessed portions are alternately arranged on the inner wall surface of the barrel 203, which is clearly shown in FIG. 4C.

Figure 9A:
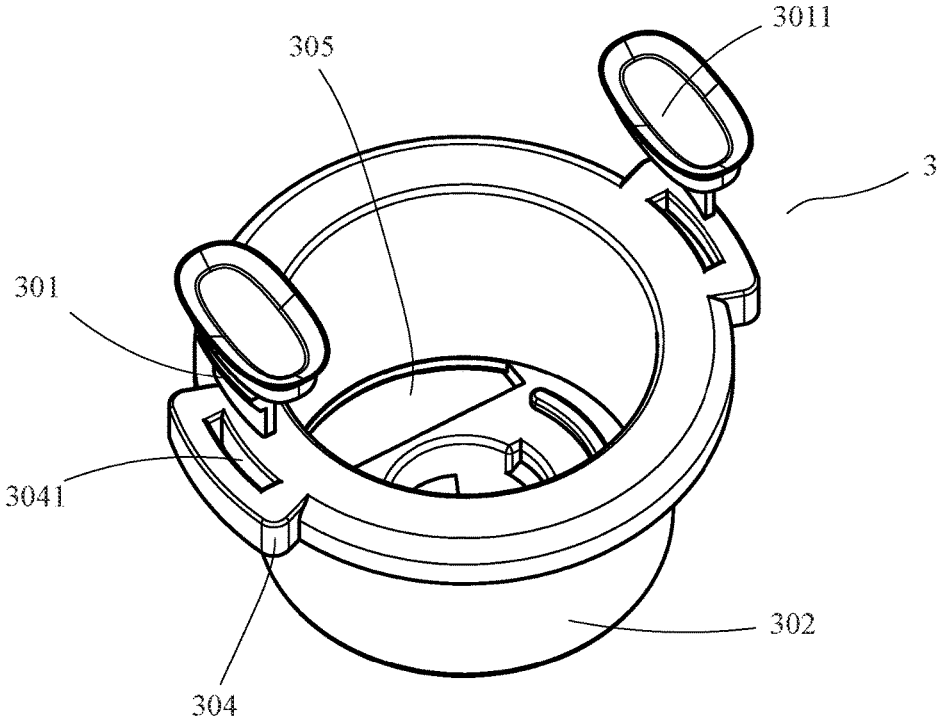
FIG. 9A is an exploded perspective view of the seal assembly constructed consistent with the preferred embodiment of the invention.
Figure 9B:
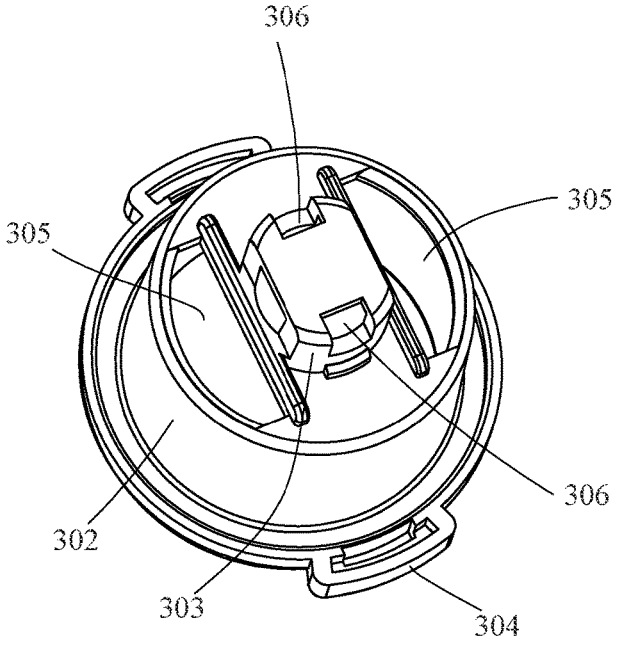
FIGS. 9B and 9C respectively show a bottom perspective view and a top view of the seal carrier shown in FIG. 9A.
Figure 9C:
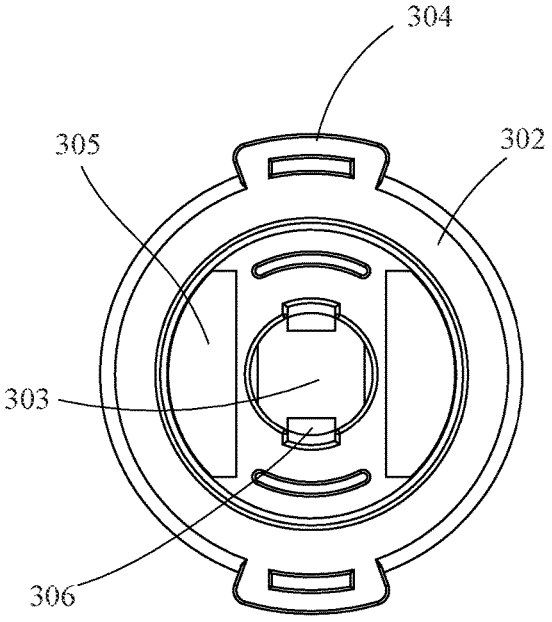

The seal assembly 3 is movably arranged beneath the lid cover 102. With reference to FIGS. 9A to 9C, the seal assembly 3 comprises a seal carrier and two drink seals 301. The seal carrier in this embodiment comprises a substantially cylindrical upper member 302 which is configured to surround movably the receiving chamber 101 of the lid body 1, and a bottomed lower member 303 which is depressed from the center portion of the bottom of the upper member 302. The cylindrical upper member 302 has two opposite lugs 304 with receiving slots 3041 through which the drink seals 301 pass with their respective head 3011 located exterior of the receiving slots 3041 to sealably close the first and second drink orifices 103, 104. The drink seal 301 is preferably made of rubber or silicon. At the bottom of the cylindrical upper member 302 there are two opposite windows 305 arranged for allowing passage of the two press-fit legs 109 extending downwardly from the receiving chamber 101 of the lid body 1. The lower member 303 has two openings 306 formed along a direction transverse to a straight line defined by the two windows 305.

Figure 10A:
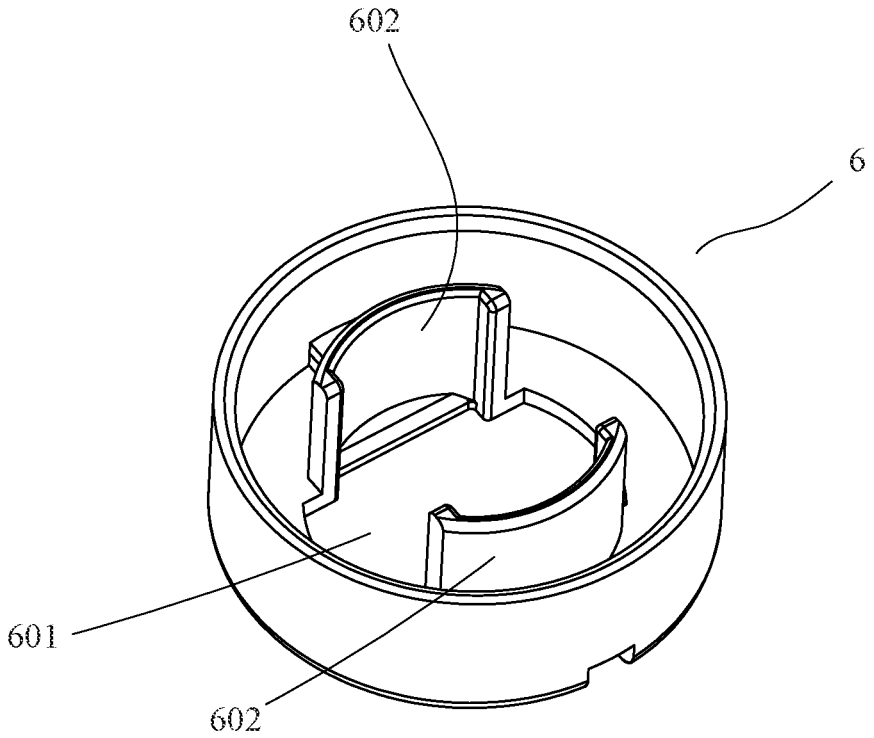
FIGS. 10A and 10B respectively show perspective top and bottom views of the spring member holder constructed consistent with the preferred embodiment of the invention.
Figure 10B:
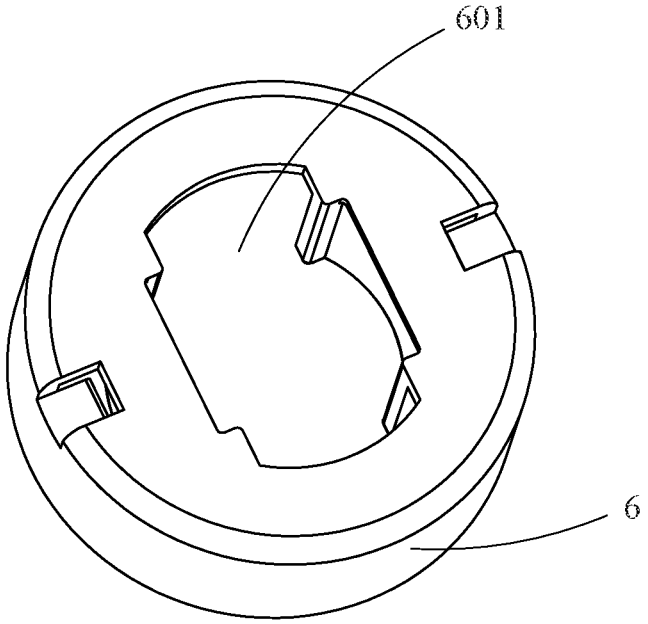

The lid assembly 100 further comprises a spring member 5 and a holder 6 for holding the spring member 5. One example of the spring member is a compression spring coiled onto the cylindrical upper member 302 and held between the lugs 304 of the seal carrier and the holder 6. The spring member is arranged to constantly apply an upward force to the seal carrier, whereby to enable the seal carrier move upwardly after the downward pressure onto the seal carrier is released, which will be discussed herein below. As shown in FIGS. 10A and 10B, the holder 6 has a center hole 601 and two tabs 602 projecting upwardly from the bottom surface of the holder 6 on opposite sides of the center hole 601. The two spaced-apart press-fit legs 109 extending downwardly from the receiving chamber 101 of the lid body 1 snugly run through the center hole 601 of the holder 6 in a manner that the press-fit legs 109 press against an inner wall of the respective tabs 602 to create a secure connection therebetween. The stop portion 110 of the press-fit legs 109 are located exterior of the holder 6 and are in abutment with the underside of the bottom of the holder 6 in order to enhance the coupling therebetween. Therefore, the holder 6 is securely coupled to the lid body 1.

One of the features of the invention is the actuator assembly 4 which is configured to synchronously actuate the cap 2 and the seal assembly 3. In this embodiment, the actuator assembly 4 is configured as a ballpoint pen ratchet mechanism in operative connection with the cap 2 and the seal assembly 3, such that, every time the ballpoint pen ratchet mechanism is activated, for instance pressed downwardly and then released, the cap 2 rotates from an inactive position where the first and second drink orifices 103, 104 are fully covered by the cap 2 and an active position where the first and second drink orifices 103, 104 are fully uncovered by the cap (i.e. exposed), and at the same time the seal assembly 3 is caused to displace between an upper position where the drink seals 301 are sealably engageable with the first and second drink orifices 103, 104, and a lower position where the drink seals 301 disengage from the first and second drink orifices 103, 104. It would be appreciated that any other mechanism can be used in order to synchronously actuate to operate the cap 2 and the seal assembly 3.

Referring to FIGS. 5A to 7, the ballpoint pen ratchet mechanism will now be explained in details. The ballpoint pen ratchet mechanism in this embodiment comprises a push plunger 401, a ratchet 402 and a compression spring 403. The lid assembly 100 further comprises a valve assembly 7 having a valve body 701. The compression spring 403 is forced to bias the push plunger 401 upward through the valve body 701.

At one end of the push plunger 401 is provided with an end sleeve 406. The top face of the end sleeve 406 is formed as a press button that protrudes beyond the through hole 202 of the cap 2 and that is configured to be pressed by a user. The other end of the push plunger 401 comes into contact with a first end 702 of the valve body 701, so that the push plunger 401, when pressed to move down, would cause the valve body 701 to move downwardly. A second end 703 of the valve body 701 is movable to be operably in abutment with the bottom surface of the lower member 303.

Figure 11A:
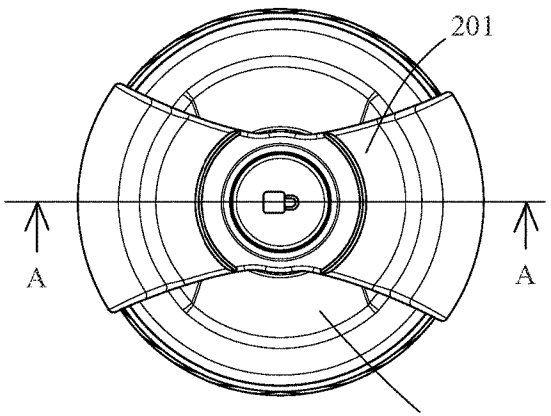
FIG. 11A is a top view of the lid assembly in a fully closed position where both the first and second drink orifices are fully closed.
Figure 11B:
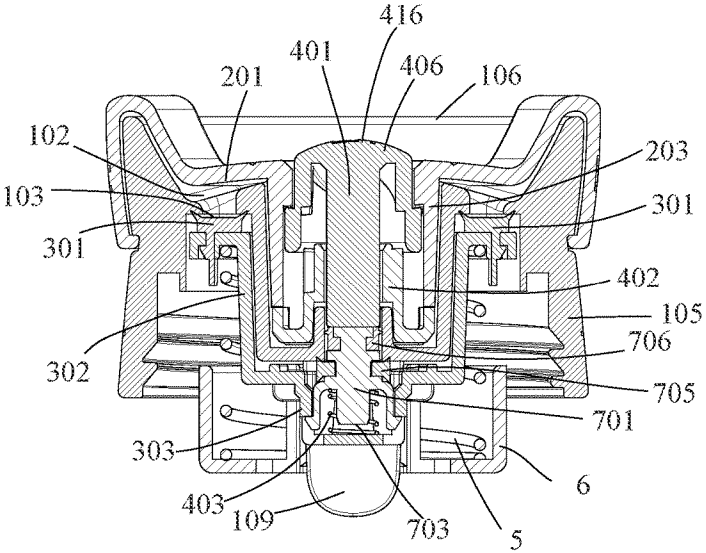
FIG. 11B is a cross-sectional view taken along line A-A of FIG. 11A.
Figure 12A:
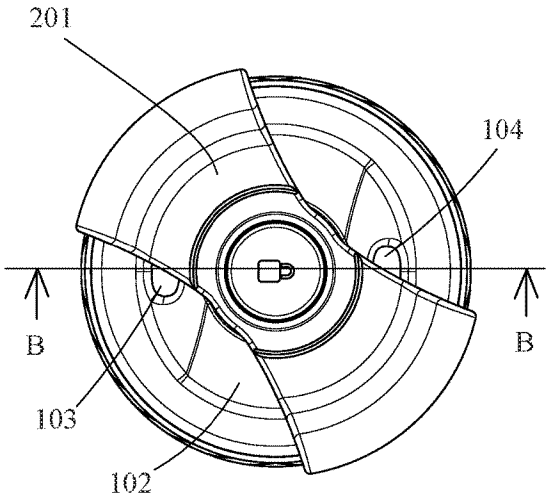
FIG. 12A is a top view of the lid assembly in a partially open position where both the first and second drink orifices are partially open.
Figure 12B:
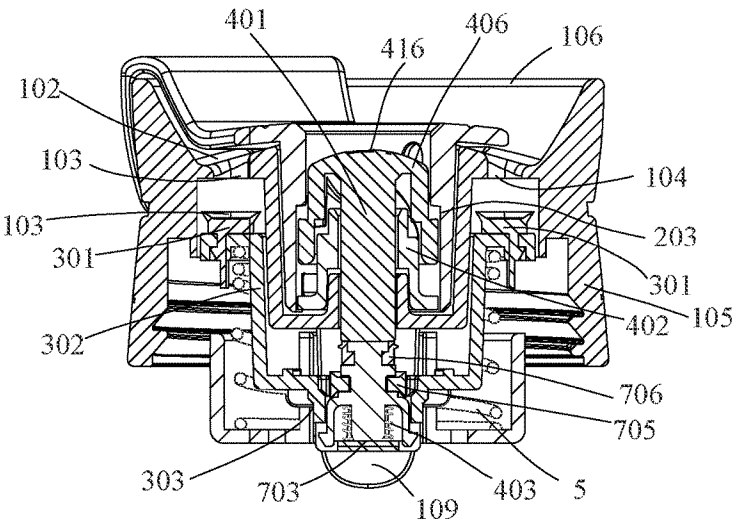
FIG. 12B is a cross-sectional view taken along line B-B of FIG. 12A.
Figure 13B:
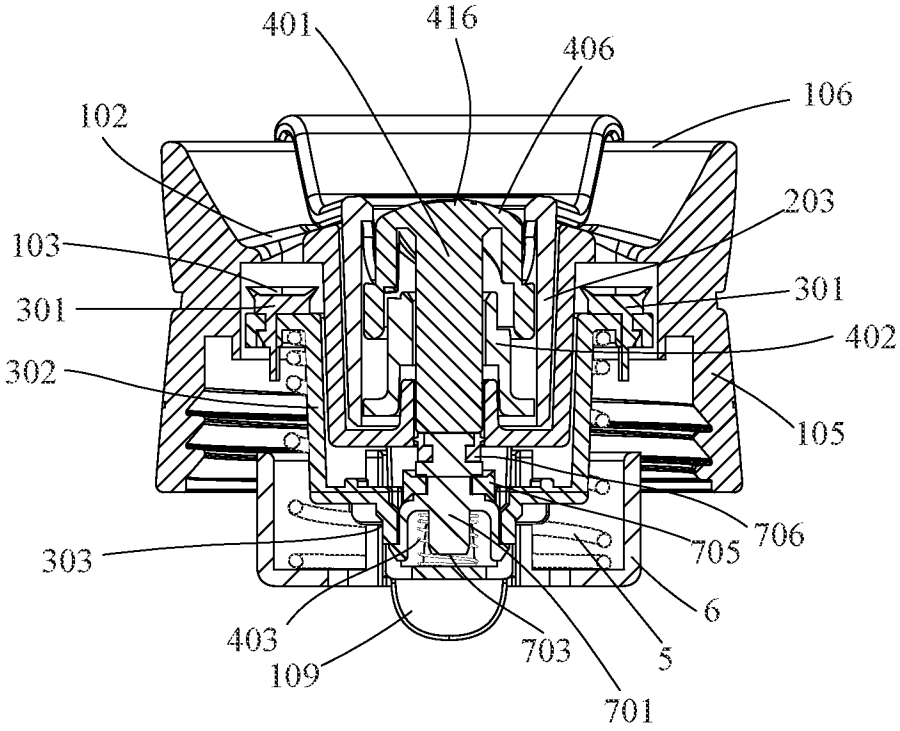
FIG. 13B is a cross-sectional view taken along line C-C of FIG. 13A.
Figure 13A:
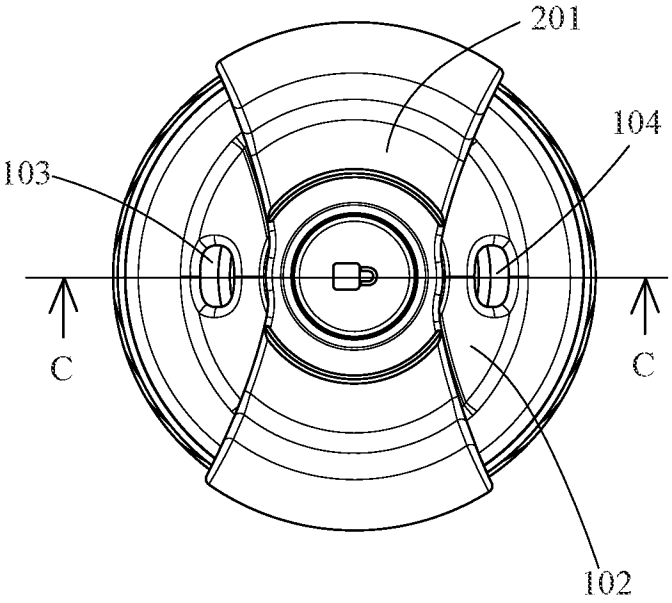
FIG. 13A is a top view of the lid assembly in a fully open position where both the first and second drink orifices are fully open.

The valve body 701 slidably passes through the hub 107 of the lid body 1 and the bottomed lower member 303 of the seal carrier (see FIGS. 11A, 12A and 13A). Two hook elements 704 extends from opposite sides of the valve body 701 to be slidably received in the respective openings 306 of the lower member 303 of the seal carrier. As described above, downward movement of the push plunger 401 would drive the valve body 701 to move downwardly until the second end 703 reaches and presses the bottom surface of the lower member 303 down. As a result of the pressure applied by the valve body 701 to the lower member 303 of the seal carrier, the whole seal carrier with the two drink seals 301 is caused to move down away from the first and second drink orifices 103, 104. The compression spring 403 is connected with the valve body 701 to constantly apply an upward force to the valve body 701 to bias the valve body 701 and indirectly bias the push plunger 401 to move upward after the pressure onto the push plunger 401 is released.

The valve assembly 7 further comprises a sealing ring 705 which is made of an elastic material, such as silicone or rubber, and arranged around the outer periphery of the valve body 701 just above the two hook elements 704 for sealing the valve assembly 7 when the lid assembly 100 is in fully closed position. When the valve body 701 is caused to move downwardly, the sealing ring 705 moves down together with the valve body 701 from the sealing position to release the sealing action, which allows for outflow of the air pressure inside the beverage container body. When the valve body 701 is caused to move upwardly, the sealing ring 705 moves up to hermetically seal the valve body 701.

Figure 2A:
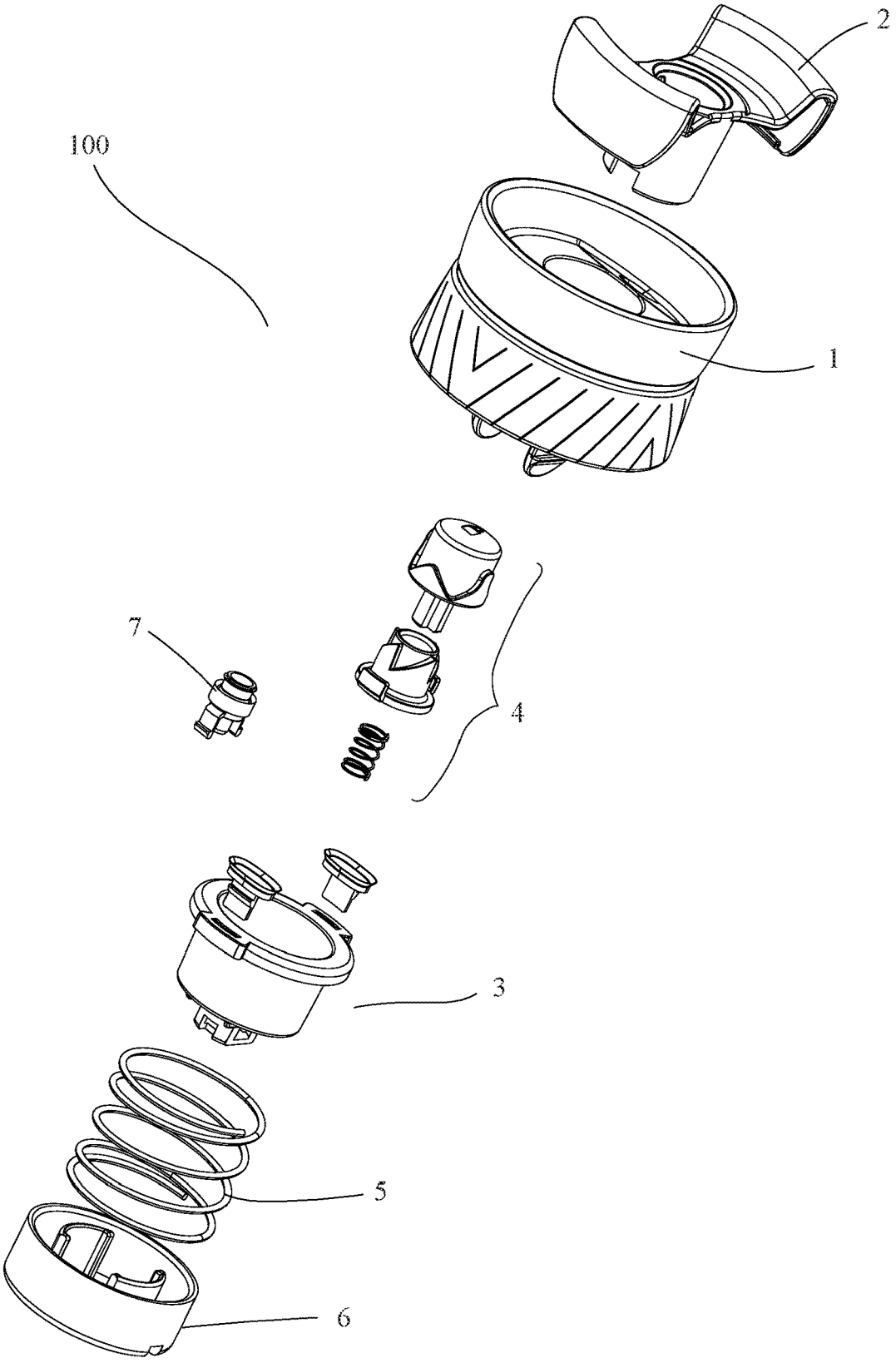
FIGS. 2A and 2B are perspective exploded views of the beverage mug shown in FIG. 1 in two different angles of view.
Figure 2B:
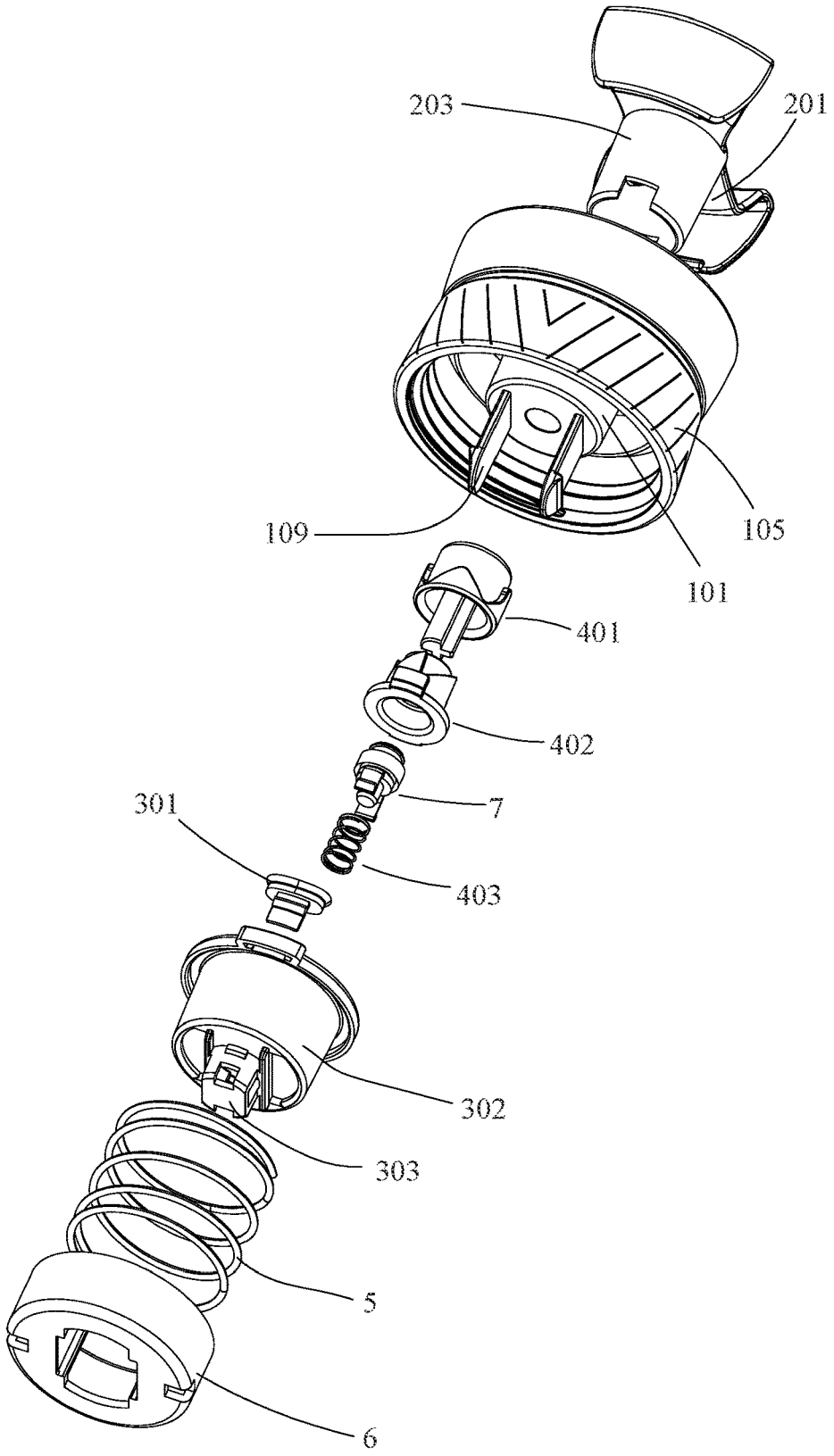

In order to enhance the sealing performance of the valve assembly 7, a gasket 706 having a gasket flange 707 is provided to surround the periphery of upper portion of the valve body 701, as shown in FIGS. 2A and 2B. The gasket 706 is configured to close the underside of the hollow hub 107 of the receiving chamber 101 of the lid body 1 in order for improved sealability of the lid body and the inside of the beverage container. This kind of gasket 706 helps to further prevent the air pressure or hot beverage inside the beverage container from escaping through the hub 107.

Figure 5A:
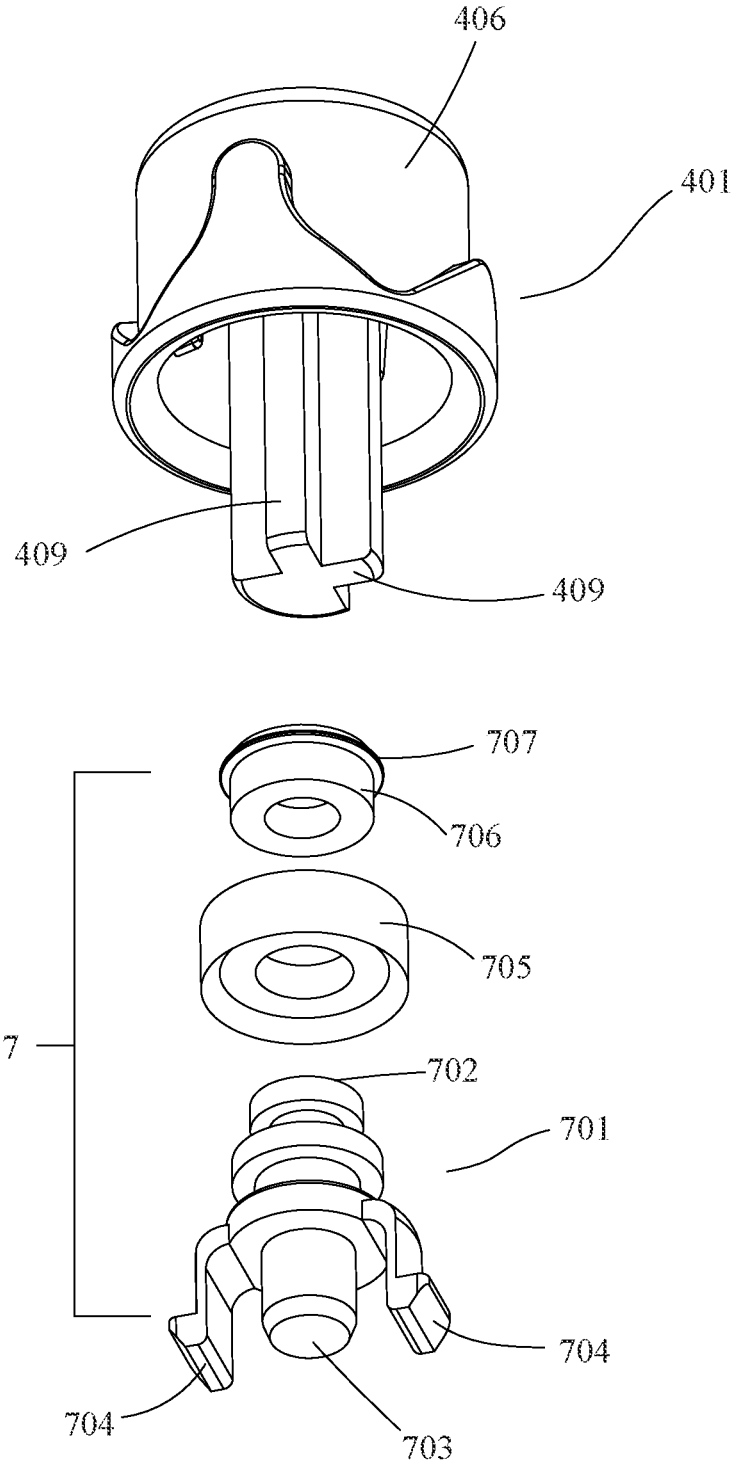
FIG. 5A is a perspective view of the push plunger and the valve assembly constructed consistent with the preferred embodiment of the invention.
Figure 5B:
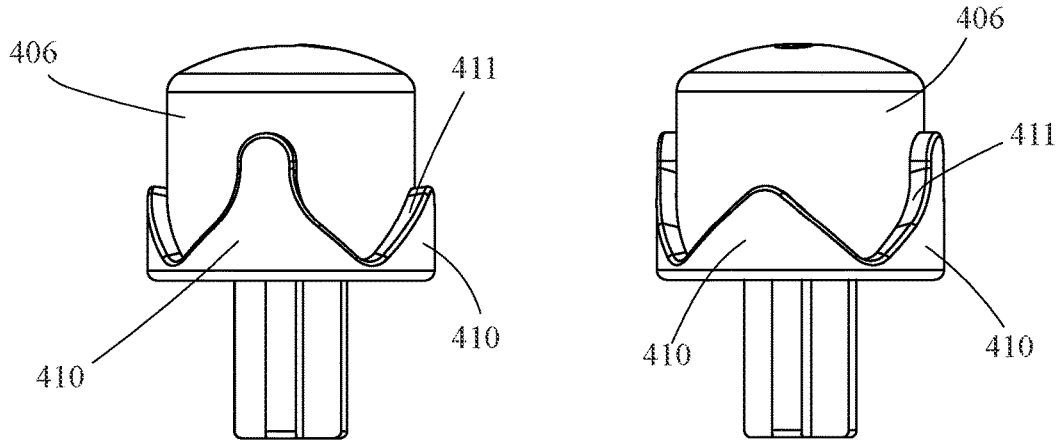
FIG. 5B shows two side views of the push plunger shown in FIG. 5A.

Now turning to FIG. 5B, as illustrated, the end sleeve 406 has four protrusions 410 formed and arranged evenly in a spaced apart fashion axially with an equal angular interval of 90 degrees on an outer wall surface thereof. The four protrusions 410 are also configured to have alternate lengths, and they are arranged such that two long protrusions and two short protrusions are alternately arranged on the outer wall surface of the end sleeve 406. In other words, one long protrusion is arranged between two short protrusions. Each of the four protrusion 410 has a top cam face 411 which cooperates with each of the four bottom cam faces 206 of the recessed portions 205 of the barrel 203 of the cap 2, causing the cap 2 to rotate around the longitudinal center axis of the lid body 1 when the push plunger 401 is forced downwardly against the cap 2 (see FIG. 5D). As described above, the four recessed portions 205 have alternate depths. When the cap 2 is rotated by the ratchet 402, the protrusions 410 of the end sleeve 406 alternately engage with the four recessed portions 205, such that the push plunger 401 is latched alternately at different axial displacements corresponding to the fully closed position and the fully open position of the drink orifices 103, 104. Therefore, the recessed portions 205 serve as height establishing means which holds the push plunger 401 alternately in an upper position and in a lower position, respectively. When the push plunger 401 moves down to the lower position, the valve body 701 is caused to move down to press the seal assembly 3 to move away from the first and second drink orifices 103, 104. In other words, the push plunger 401 in the upper position is correspondent to the seal assembly 3 in the upper position where the drink seals are sealably engageable with the first and second drink orifice 103, 104, and the push plunger 401 in the lower position is correspondent to the seal assembly 3 in the lower position where the drink seals disengage from the first and second drink orifice 103, 104.

Figure 5C:
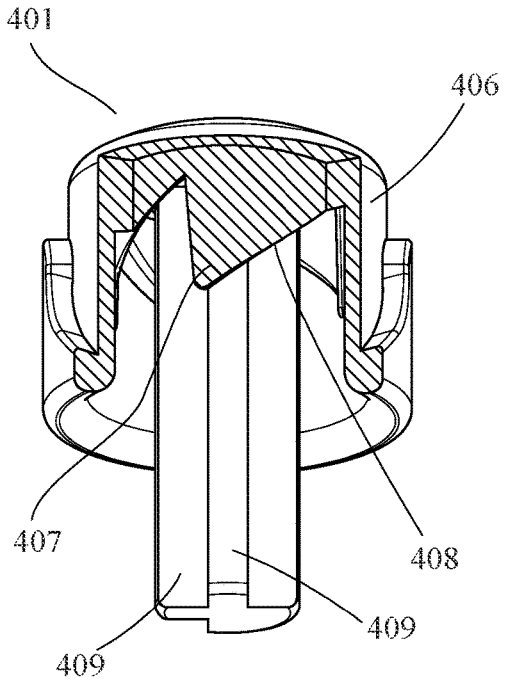
FIG. 5C is a perspective view, partially broken away and partially in hidden view, of the push plunger.
Figure 5D:
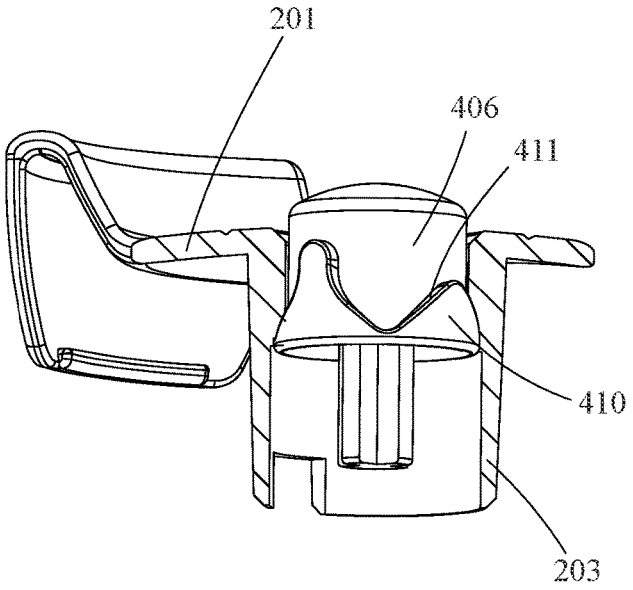
FIG. 5D is a view showing the cap of FIG. 4C engages with the end sleeve of the push plunger.

Turning to FIG. 5C, the end sleeve 406 has four downwardly extending portions 407 arranged evenly on the circumference of the inner side wall of the end sleeve 406. Each of the downwardly extending portions 407 has a bottom cam face 408. Two axial ribs 409 extend from the push plunger 401. The axial ribs 409 are received and slidable in the axial slots 108 of the inner wall of the hub 107 of the lid body 1 (see FIG. 3C). Therefore, the push plunger 401 is non-rotatable but longitudinally displaceable relative to the lid body 1.

Figure 6:
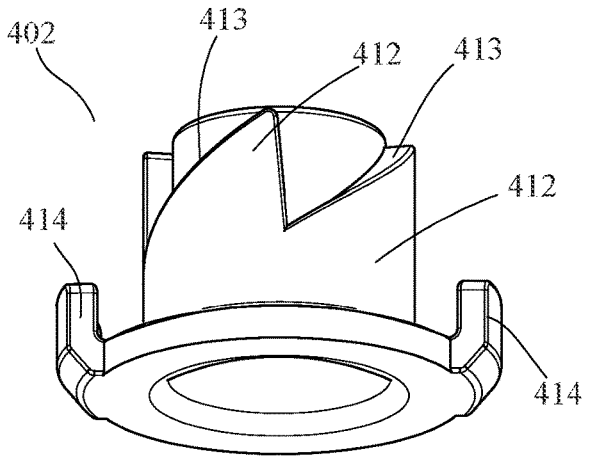
FIG. 6 is a perspective bottom view of the ratchet that cooperates with the push plunger shown in FIG. 5A.
Figure 7:
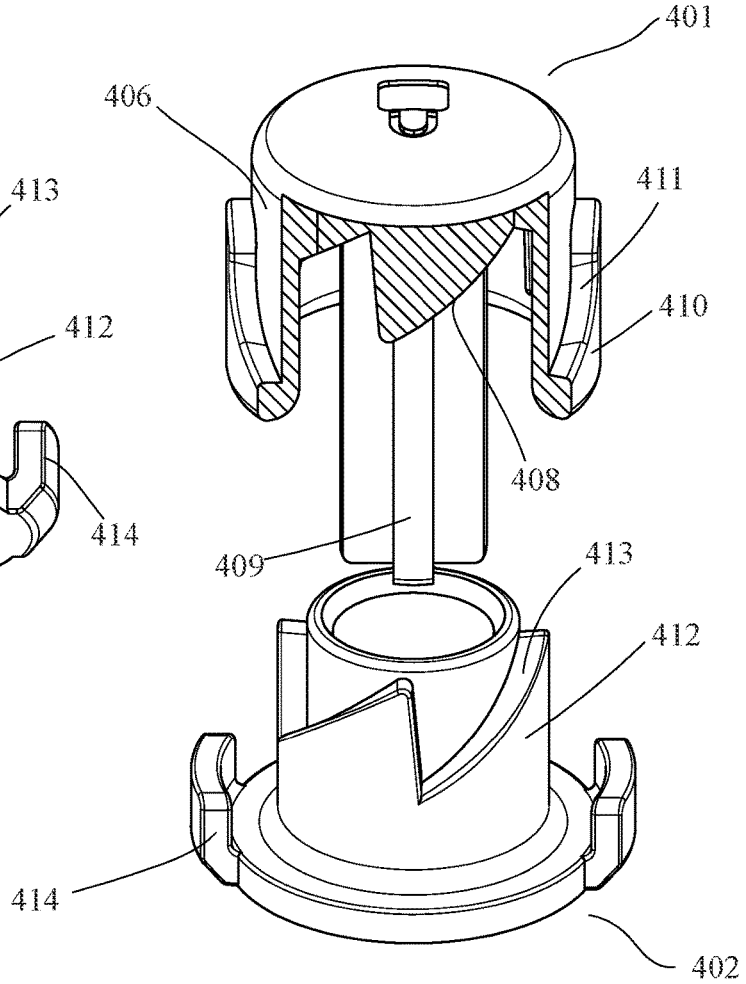
FIG. 7 is a perspective view showing the push plunger and the ratchet.

As shown in FIGS. 6 and 7, the ratchet 402 is shaped as a hollow cylinder with an outer diameter substantially identical to an inner diameter of the end sleeve 406 of the push plunger 401. Four upwardly extending portions 412 are formed evenly and circumferentially on the outer wall surface of the hollow cylinder. Each of the upwardly extending portions 412 has a top cam face 413 which cooperates with each of four bottom cam faces 408 formed on the inner wall of the end sleeve 406 when the push plunger 401 is pressed against the ratchet 402. The ratchet 402 has two opposite stubs 414 engageable with the respective notches 207 of the barrel 203 of the cap 2, whereby enabling coupling of the ratchet 402 with the cap 2. Therefore, the cap 2 is driven to rotate by rotation of the ratchet 402. Due to the cooperating cam faces 408 and 413, when the push plunger 401 is forced downwardly against the ratchet 402, the ratchet 402 tends to rotate relative to the push plunger 401 in the anti-clockwise direction when viewed from the top (as the push plunger 401 is non-rotatable relative to the lid body 1). The cap 2 is coupled to the ratchet 402 due to the engagement of the notches 207 with the stubs 414, therefore the rotation of the ratchet 402 drives the cap 2 to rotate by 90 degrees with respect to the lid body 1 and the lid cover 102 every time the press button is pressed down.

Figure 8A:
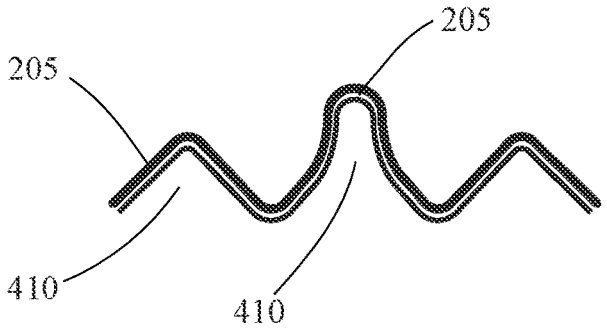
FIGS. 8A to 8C are schematic views showing how recessed portions formed on inner wall surface of the barrel of the cap and protrusions formed on outer wall surface of the end sleeve of the plunger portion are interfitting during a complete process of rotating the cap.
Figure 8B:
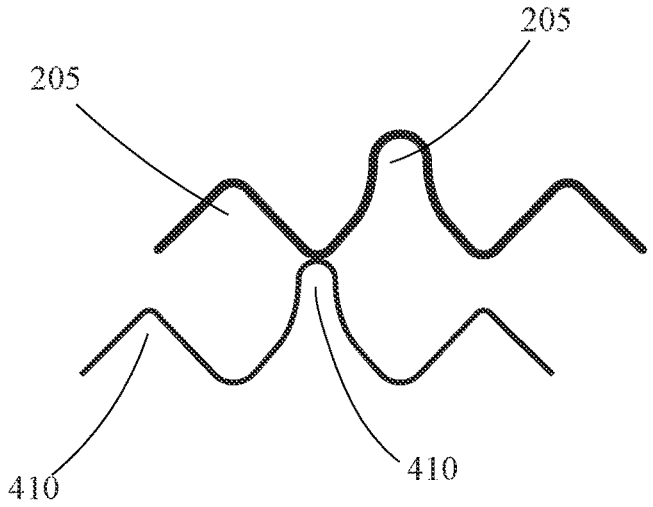
Figure 8C:
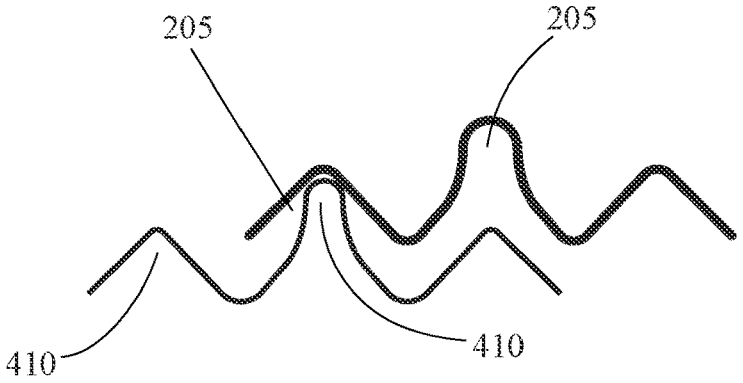

FIGS. 8A to 8C schematically show how the protrusions 410 of the end sleeve 406 cooperate with the recessed portions 205 of the barrel 203 of the cap 2. When the long protrusions 410 are engaged with the deep recessed portions 205, and the short protrusions 410 are engaged with the shallow recessed portions 205 as shown in FIG. 8A, the push plunger 401 is locked to remain in the upper position; when downward pressure is applied to the end sleeve 406 of the push plunger 401, the end sleeve 406 with the protrusions 410 moves downwardly and at the same time the cap 2 is caused to rotate by the ratchet 402 which cooperates with the bottom cam faces 408 on the inner wall of the end sleeve 406. The protrusions 410 disengage from the recessed portions 205 until the lowest point of the recessed portions 205 rotates to come into contact with the highest point of the protrusions 410, and at this point, the push plunger 401 is in the lowest position (see FIG. 8B). The cap 2 continues to rotate due to the cooperating cam faces 206, 411 of the cap 2 and the ratchet 402 until the shallow recessed portions 205 are engaged with the long protrusions 410 as shown in FIG. 8C, the push plunger 401 moves upwardly from the lowest position shown in FIG. 8B by the shallow recessed depth to a position corresponding to the lower position of the push plunger 401. The plush plunge 401 is locked to remain in the lower position.

FIGS. 11A to 13B are top views and cross-sectional views of the lid assembly 100 in fully closed position, partially open position and fully open position, respectively. Turning now to FIGS. 11A and 11B, the first and second drink orifices 103, 104 are fully covered up by the panel 201 of the cap 2, and the beverage in the mug 200 cannot be dispensed. The cap 2 and the end sleeve 406 are engaged with each other as shown in FIG. 8A, and the push plunger 401 is in the upper position with the top face of the end sleeve 406 formed as a press button 416 protruding beyond the lid cover 102. The valve body 701 stays away from the lower member 303 of the seal assembly 3, namely the push plunger 401 does not act on the seal assembly 3. Therefore, the seal assembly 3 remains the upper position where the two drink seals 301 sealably engage with the first and second drink orifice 103, 104.

To open the drink orifices 103, 104, the press button 416 is pressed (for example, by a finger of a user) downwardly against the ratchet 402 and at the same time to move the valve body 701 downwardly by the push plunger 401. The ratchet 402 rotates in the anti-clockwise direction when viewed from the top, which in turns causes the cap 2 to rotate to expose the drink orifices 103, 104. Synchronously, the push plunger 401 first reaches its lowest position correspondent to FIG. 8B, and accordingly the valve body 701 moves to press down the bottom of the lower member 303 of the seal assembly, whereby the drink seals 301 move downwardly farthest away from the first and second drink orifices 103, 104. At this point, the panel 201 rotates by about 45 degrees to partially expose the drink orifices 103, 104 (see FIGS. 12A and 12B).

Then the downward pressure applied to the press button 416 is released (for example, by removing the finger of the user), the push plunger 401 is forced to move upwardly by the compression spring 403 to reach its lower position correspondent to FIG. 8C. The seal assembly 3 is forced to move upwardly by the spring member 5 but is constrained by the push plunger 401 located in the lower position to be spaced from the drink orifices 103, 104. Synchronously, the upward movement of the push plunger 401 results in rotation of the ratchet 402, which causes the cap 2 to perform continued rotation by about further 45 degrees (see FIGS. 13A and 13B). The orifices 103, 104 are in the fully open positions to allow for dispensing of the beverage in the beverage mug 200 from the first or second drink orifice 103, 104.

When the press button 416 is pressed downwardly and then released again, the above described process repeats, the cap 2 is actuated to rotate by 90 degrees to cover up the drink orifices 103, 104, and synchronously the seal assembly 3 is actuated to be displaceable from the lower position to the upper position. In other words, every time the press button 416 is pressed downwardly and then released, the cap 2 and the seal assembly are alternately held in either of their respective two positions, which correspond to the open and closed positions of the drink orifices 103, 104.

Thus the present invention provides a lid assembly characterized by having an actuator assembly configured to implement the open and closing operations of the drink orifices with one hand, which requires only one single press onto the push button for opening and closing the drinking orifice.

While the above described are preferred embodiments of The lid assembly of the present invention with what is presently considered to be the most practical and preferred arrangement, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

What is claimed is:

1. A lid assembly for a beverage container, comprising:

a lid comprising a lid body having a receiving chamber, a lid cover having at least one drink orifice extending therethrough, and a side wall extending downwardly and circumferentially from the lid cover to define an internal space, a seal assembly mounted in the internal space of the lid, the seal assembly having a seal carrier and at least one drink seal carried on the seal carrier for closing the drink orifice, wherein the seal carrier is displaceable between an upper position where the drink seal is sealably engageable with the drink orifice, and a lower position where the drink seal is disengaged from the drink orifice, a cap rotatably placed over the lid cover and rotatable between an inactive position where the drink orifice is fully covered by the cap and an active position where at least a part of the drink orifice is uncovered by the cap, and an actuator assembly in operative connection with the cap and the seal assembly, the actuator assembly configured to synchronously actuate the cap to rotate between the inactive position and the active position, and actuate the seal carrier to be displaceable between the upper position and the lower position, wherein the cap is actuated to rotate to the inactive position when the seal carrier is actuated to the upper position to close the drink orifice, and the cap is actuated rotate to the active position when the seal carrier is actuated to the lower position to open the drink orifice for dispensing the beverage stored in the container.

2. The lid assembly according to claim 1, wherein the actuator assembly is configured to move to be alternately latched in a plurality of latched positions, so that the movement of the actuator assembly to one of the plurality of latched position drives synchronously the cap to the inactive position and the seal carrier to the upper position, and the movement of the actuator assembly to the other of the plurality of latched position drives synchronously the cap to the active position and the seal carrier to the lower position, thereby allowing to close and open the drink orifice.

3. The lid assembly according to claim 2, wherein the actuator assembly is configured as a ballpoint pen ratchet mechanism arranged in the lid, the ballpoint pen ratchet mechanism comprising:

a push plunger connected to a compression spring which is forced to move the push plunger upward, at least a part of the push plunger being movably received in the receiving chamber of the lid body and configured to act on the seal carrier so that the seal assembly is displaceable between the upper and lower positions, and a ratchet coupled to the cap, wherein the push plunger and the ratchet comprise cooperating cam faces whereby the ratchet tends to rotate when the cam faces of the push plunger are forced against the cam faces of the ratchet, and the rotation of the ratchet causes to rotate the cap between the inactive position and the active position.

4. The lid assembly according to claim 3, wherein the push plunger has an end sleeve and a free end, and the cam faces of the push plunger are formed on an inner wall surface of the end sleeve to cooperate with the cam faces formed on the ratchet.

5. The lid assembly according to claim 4, wherein the end sleeve has a plurality of protrusions formed and arranged evenly in a spaced apart fashion on an outer wall surface thereof; and wherein the cap comprises:

a panel with a through hole through which a top of the end sleeve is exposed, and a hollow barrel projecting downwardly from the through hole circumferentially and encasing the end sleeve, the barrel having a plurality of recessed portions formed and arranged evenly in a spaced apart fashion on an inner wall surface of the barrel, wherein the cap is actuated by the ballpoint pen ratchet mechanism such that the recessed portions of the barrel alternately engage with or disengage from the respective protrusions of the end sleeve, thereby allowing the cap to rotate between the inactive and active positions.

6. The lid assembly according to claim 5, wherein the lid cover has an annular raised rim that encircles the lid cover, and the panel has a guiding groove at each end of the panel, wherein the guiding grooves are rotatably fitting onto the raised rim of the lid cover, so as to guide the rotation of the panel with respect to the lid cover.

7. The lid assembly according to claim 5, wherein a top of the end sleeve is configured as a push button that protrudes beyond the through hole of the panel of the cap.

8. The lid assembly according to claim 3, wherein a hub extends upwardly from a bottom surface of the receiving chamber of the lid body, and wherein the push plunger slidably runs through the hub, and the ratchet is configured to be rotatable about the hub.

9. The lid assembly according to claim 8, wherein the hub comprises one or more axial slots formed on an inner wall thereof; and the push plunger comprises one or more axial ribs engageable with the respective axial slots, thereby preventing the push plunger from rotation with respect to the lid body.

10. The lid assembly according to claim 4, further comprises a valve assembly having a valve body with a first end in contact with the free end of the push plunger and a second end movable to be operably in abutment with the seal carrier.

11. The lid assembly according to claim 10, wherein the seal carrier comprises a bottomed lower member operably in abutment with the second end of the valve body, so that the valve assembly, when pressed by the push plunger, moves to longitudinally displace the seal carrier with the drink seal.

12. The lid assembly according to claim 11, wherein the bottom of the lower member has two opposite openings to allow for two lateral elements of the valve body to movably pass therethrough.

13. The lid assembly according to claim 10, wherein the compression spring is connected to the valve body and held on the bottomed lower member of the seal carrier.

14. The lid assembly according to claim 3, wherein a spring member is provided beneath the seal carrier to bias the seal carrier upward.

15. The lid assembly according to claim 14, wherein a holder is provided to hold the spring member and secured to the lid body.

16. The lid assembly according to claim 15, wherein two spaced-apart press-fit legs extend from an underside of the receiving chamber and are adapted for passing through the holder in a manner that the press-fit legs press against opposite tabs formed in the holder for a secure connection therebetween.

17. The lid assembly according to claim 1, wherein the cap is actuated to rotate by an angle in the range of 0 to 90 degrees responsive to every single press onto the actuator assembly.

18. The lid assembly according to claim 1, wherein two drink orifices are defined in the lid cover on opposite sides.

19. A beverage container comprising:

a container body including an open-top wall structure defining a receptacle for receiving beverage; and a lid assembly according to claim 1.

* * * * *